US006775934B1

(12) United States Patent
Gallik et al.

(10) Patent No.: US 6,775,934 B1
(45) Date of Patent: Aug. 17, 2004

(54) HEAD APPAREL EMBROIDERY HOOP AND ALIGNMENT DEVICE

(76) Inventors: Gerald R. Gallik, 4163 Rainey Woods Dr., Memphis, TN (US) 38125; Robert G. Gallik, Jr., 7106 Old North Dr., Memphis, TN (US) 38125

( * ) Notice: Subject to any disclaimer, the term of this patent is extended or adjusted under 35 U.S.C. 154(b) by 0 days.

(21) Appl. No.: 10/602,767

(22) Filed: Jun. 25, 2003

(51) Int. Cl.[7] ..... D06C 3/08
(52) U.S. Cl. ..... 38/102.2; 112/103
(58) Field of Search ..... 38/102.1, 102.2, 38/102.91; 112/103, 475.11; 101/127.1; 33/1 G, 2 R, 11, 12, 501; 160/380

(56) References Cited

U.S. PATENT DOCUMENTS

| | | | | |
|---|---|---|---|---|
| 3,664,288 A | | 5/1972 | Von Boden et al. | |
| 4,357,885 A | * | 11/1982 | Stockton | 112/103 |
| 4,598,488 A | | 7/1986 | Inteso | |
| 4,762,076 A | * | 8/1988 | Wakaizumi | 112/103 |
| 4,774,778 A | * | 10/1988 | Williams | 38/102.2 |
| 4,831,753 A | | 5/1989 | Inteso | |
| 5,144,899 A | * | 9/1992 | Allen | 112/103 |
| 5,555,828 A | | 9/1996 | Rowley | |
| 5,598,797 A | | 2/1997 | Patterson | |
| 5,630,370 A | | 5/1997 | Herbach | |
| 5,649,496 A | | 7/1997 | Morita et al. | |
| 5,884,571 A | | 3/1999 | Valadez et al. | |
| 6,095,068 A | * | 8/2000 | Hori | 112/103 |
| 6,116,174 A | * | 9/2000 | Melton | 112/103 |
| 6,240,863 B1 | * | 6/2001 | Vickroy et al. | 112/475.18 |

FOREIGN PATENT DOCUMENTS

GB 2228749 9/1990

* cited by examiner

*Primary Examiner*—Ismael Izaguirre
(74) *Attorney, Agent, or Firm*—Richard C. Litman

(57) ABSTRACT

The head apparel embroidery hoop and alignment device is a frame defining an opening adapted for placement on a cap driver, the frame having an outer perimeter adapted for securing the hoop to a containment hoop of an embroidery machine. A removable hat bill retaining plate secures the hat bill portion of a hat between the retaining plate and the frame. A centered rear groove, disposed in the rear of the frame, facilitates proper alignment of the hat within the. embroidery hoop. The clamping force acting upon the retaining plate is provided by threaded knobs receiving threaded posts molded in the frame and passing through apertures cut in the retaining plate, thereby cooperatively engaging the hat bill between the retaining plate and the frame.

12 Claims, 4 Drawing Sheets

HEAD APPAREL EMBROIDERY HOOP AND ALIGNMENT DEVICE

BACKGROUND OF THE INVENTION

1. Field of the Invention

The present invention relates to embroidery. More specifically, the invention is a device for aligning and holding a hat, visor, or other head apparel in place in a sewing machine or an embroidery machine.

2. Description of the Related Art

Modern embroidery machines are typically operated under computer control. Various devices and improvements have been designed to adapt modern embroidery machines for sewing logos, monograms, emblems, and various other designs and patterns on hats popularly known as baseball caps. The cap will typically be placed in a clamping device known as a cap frame, referred to generally as a hoop, the hoop in turn being mounted on a computer controlled hoop guide, also known as the X-Y driver, of an embroidery machine, the hoop guide being manipulated to present different sewing areas to the sewing head of the embroidery machine.

It should be noted that the manners by which hoops are attached and/or released from an embroidery machine on the one hand, and a bracket attached to a hooping device work surface on the other hand, often differ significantly. U.S. Pat. No. 5,555,828, issued to Donald G. Rowley in September, 1996, discloses a hoop attachment assembly for accurately and securely mounting an embroidery hoop frame to the embroidery machine. Similarly U.S. Pat. No. 5,630,370, issued to Mathias Herbach in May, 1997, discloses a device for detachably fastening an embroidery frame to the X-Y driver of an embroidery machine.

Ronald Inteso, in U.S. Pat. No. 4,598,488 issued in July 1986, presents an alternative approach for an embroidery frame, in which the hoop is easily mounted directly to an embroidery machine without a special adaptor. The '488 patent describes an embroidery frame for caps having a top element and a bottom element to clamp the brim at its free end, with clips extending over the top surface of the brim from under the top element of the clamp to the base of the cap. A clamp extends across the frame and comprises a cross-member with a number of teeth that penetrate and grab a portion of a hat to be embroidered. Intenso describes an improvement to this device in U.S. Pat. No. 4,831,753, issued May 23, 1989, in which the brim of the cap is held between a front member of the frame and a clamp. The front member has a lever mounted thereon, which raises and lowers a curved rod that secures the cap at the rear of the brim. It will be noted that the purpose of the clips of the first device and the rod of the second device is to pull the front face of the cap taut in order to minimize distortion in the sewing, and that the position of the lever necessarily limits the sewing head's access to the sewing area.

U.S. Pat. No. 5,884,571, issued to Valadez et al. in March, 1999, discloses a embroidery hoop assembly which retains a fabric workpiece securely in place by the use of two securing members, a main clamp to hold the wide end of the workpiece, and an elastic restraint to hold the free end. The main clamp has a wide, spring-loaded bar cooperating with a fixed support to keep the fabric taut over its width, while the elastic restraint keeps the fabric pulled flat, so that the embroidery can be properly applied.

U.S. Pat. No. 3,664,288, issued to Weidlin Von Boden et al. in May, 1972, discloses a fabric-holding clamp for embroidery machines comprising a pair of hinged, triangular-shaped plates between which a fabric piece is inserted. Compressible, non-slip areas hold the fabric taut across openings in the plates.

Other devices which improve the embroidery process include: U.S. Pat. No. 5,598,797, issued Feb. 4, 1997 to Dennis W. Patterson, describing an alignment stand for aligning the cap in the cap frame before securing it to the machine; U.S. Pat. No. 5,649,496, issued to Morita, et al. Jul. 22, 1997, for improved means to stitch on the temporal area of the cap; and U.K. Patent 2,228,749, published Sep. 5, 1990, describing a device to clamp a frame in an embroidery machine using three-point clamping of the frame.

A problem, which has not been adequately addressed by the conventional devices results from the hat not being in proper alignment with the embroidery frame. This is especially true in regards to the rear of the hat, which, if incorrectly aligned, would tend to offset the embroidered design on the soft portion of the hat regardless of whether the front bill of the hat is aligned and secured.

None of the above inventions and patents, taken either singly or in combination, is seen to describe the instant invention as claimed. In particular, none are seen to describe a hat hoop that enables a user to align both the front and rear of a hat in an embroidery frame. Thus a hat frame for embroidery solving the aforementioned problems is desired.

SUMMARY OF THE INVENTION

The present invention is a head apparel embroidery hoop and alignment device for use in conjunction with a machine for embroidering and monogramming hats.

The device may be made of any non-metallic, thermoplastic material and works by clamping the head apparel, such as a baseball cap, between a movable plate and a frame having a stationary planar surface. Threaded posts captured by threaded knobs provide the clamping force securing the hat brim to the frame. The device uses alignment marks to ensure the correct axial alignment for the article to be embroidered. The bottom of the device is smooth to ensure good adhesion with a sheet of adhesive stabilizing material, which is used to hold the article in position.

The device is utilized by aligning the embroidery hoop inside a shaped containment hoop provided by the manufacturer of the embroidery machine, using alignment indicia disposed on both the perimeter of the embroidery hoop and the containment hoop.

Accordingly, it is a principal object of the invention to provide a head apparel embroidery hoop and alignment device that has an embroidery frame that includes indicia facilitating the alignment of a hat or similar item of apparel within the frame during embroidering.

It is another object of the invention to provide a head apparel embroidery hoop and alignment device having a molded plastic frame fitting within the containment hoop of a predetermined embroidering machine.

It is a further object of the invention to increase the available sewing area on the front surface of a cap by providing a head apparel embroidery hoop and alignment device that has an alignment plate to prevent the brim from obstructing the sewing area of the cap.

Still another object of the invention is to provide an economical head apparel embroidery hoop and alignment device for improving the efficiency of embroidering machines as they are used to place embroidering on caps.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
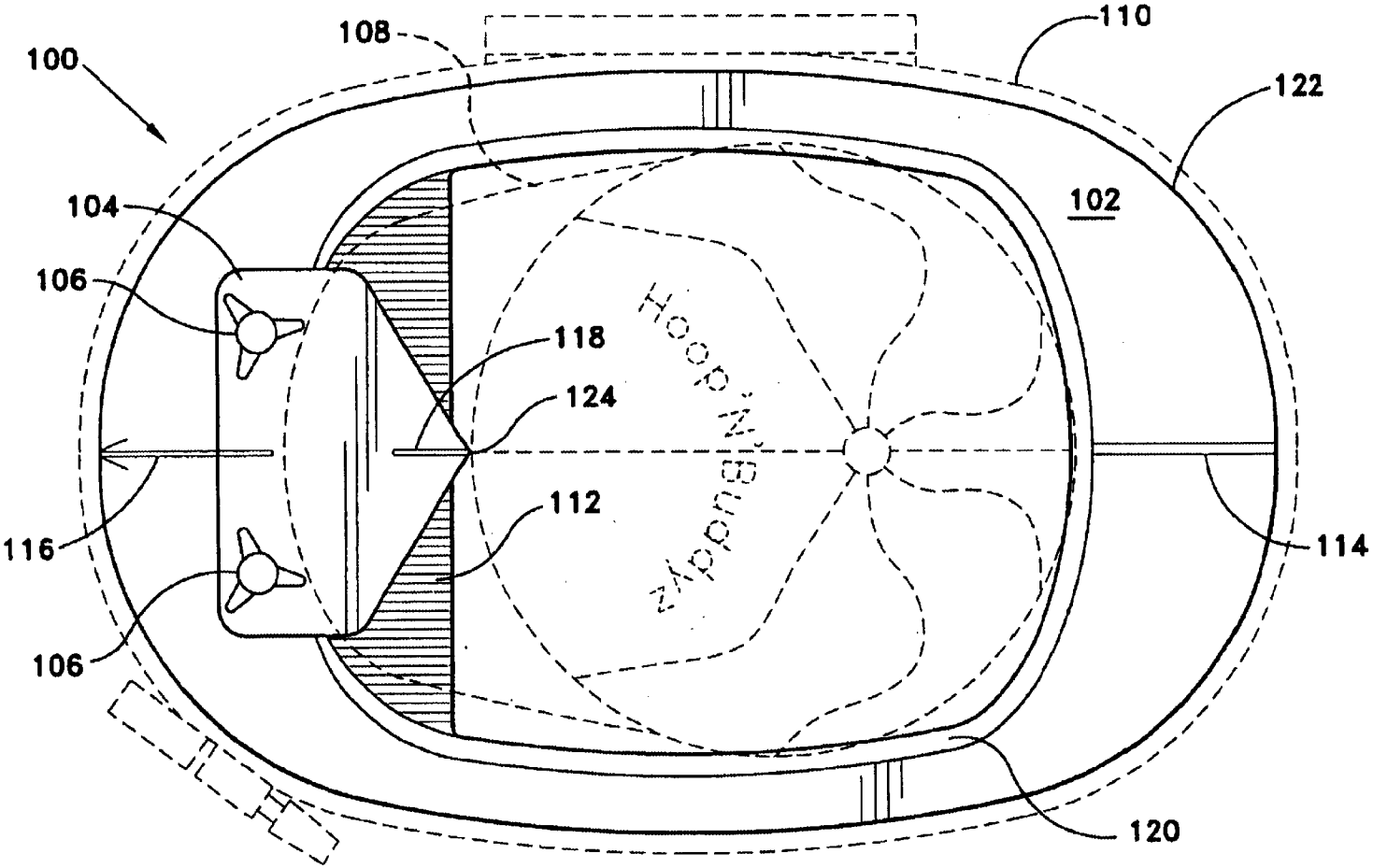
FIG. 1 is a top view of a head apparel embroidery hoop and alignment device according to the present invention.

The present invention is a head apparel embroidery hoop and alignment device, designated generally as 100 in the drawings. The embroidery hoop 100 shown in FIG. 1 comprises a frame 102 defining an opening adapted for receiving a hat to be embroidered, the frame 102 being substantially flat and planar and having an outer perimeter 122 adapted to be secured in the matching standard containment hoop 110 of an embroidery machine. A removable hat brim retaining plate 104 cooperatively engages the hat bill portion of a cap 108, securing the cap 108 between the retaining plate 104 and the frame 102. A centered rear groove 114, disposed in the rear of the frame 102, facilitates proper alignment of the hat within the embroidery hoop 100.

The embroidery hoop 100 is made of a non-metallic, thermoplastic material and may be molded to fit the outer containment hoop 110 of almost any embroidery machine known to those in the embroidery arts. As best illustrated by the exploded view of the embroidery hoop 100 in FIG. 2, the clamping force acting upon the retaining plate 104 is provided by threaded knobs 106 tightened on threaded posts 202 which are molded in the frame 102 and which pass through apertures 206 cut in the retaining plate 104.

Figure 2:
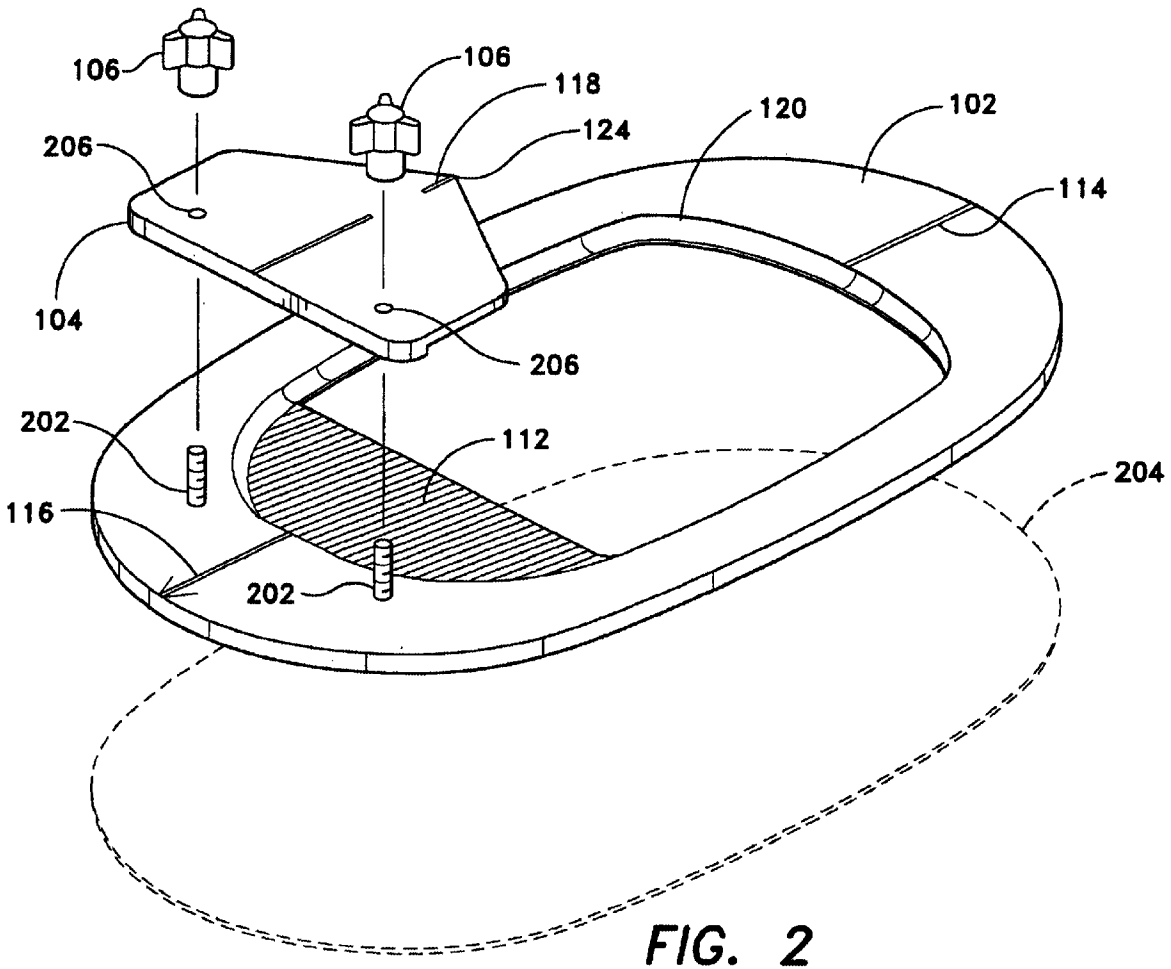
FIG. 2 is an exploded perspective view of the head apparel embroidery hoop and alignment device according to the present invention.
Figure 3:
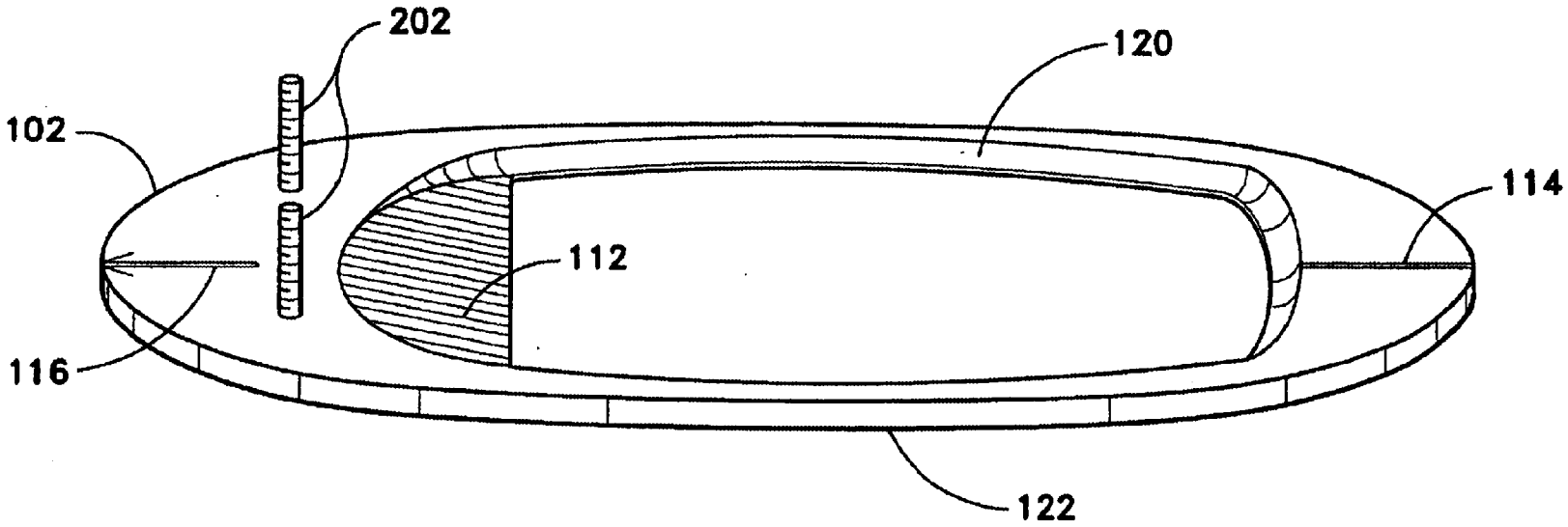
FIG. 3 is a side perspective view of the frame portion of the head apparel embroidery hoop and alignment device according to the present invention.

FIGS. 2 and 3 illustrate the curved radius of the interior perimeter 120 of the frame 102, the radius serving to deflect errant movements of the embroidery needle outside of the embroidery area, which unless deflected, would cause the embroidery needle to break against the hard flat surface of the frame 102.

FIG. 3 further illustrates the sloped ribbed surface 112 of the portion of the frame 102 disposed directly underneath the retaining plate 104. The inward sloping surface 112 prevents distortion of the embroidered surface by advantageously angling the brim of the hat, thereby providing a smooth and continuous transition from the top surface of the frame 102 to the surface of the adhesive stabilizer 204. The ribbing on the surface 112 beneath the hat bill operates to retain the hat in proper alignment with frame 102.

Figure 4:
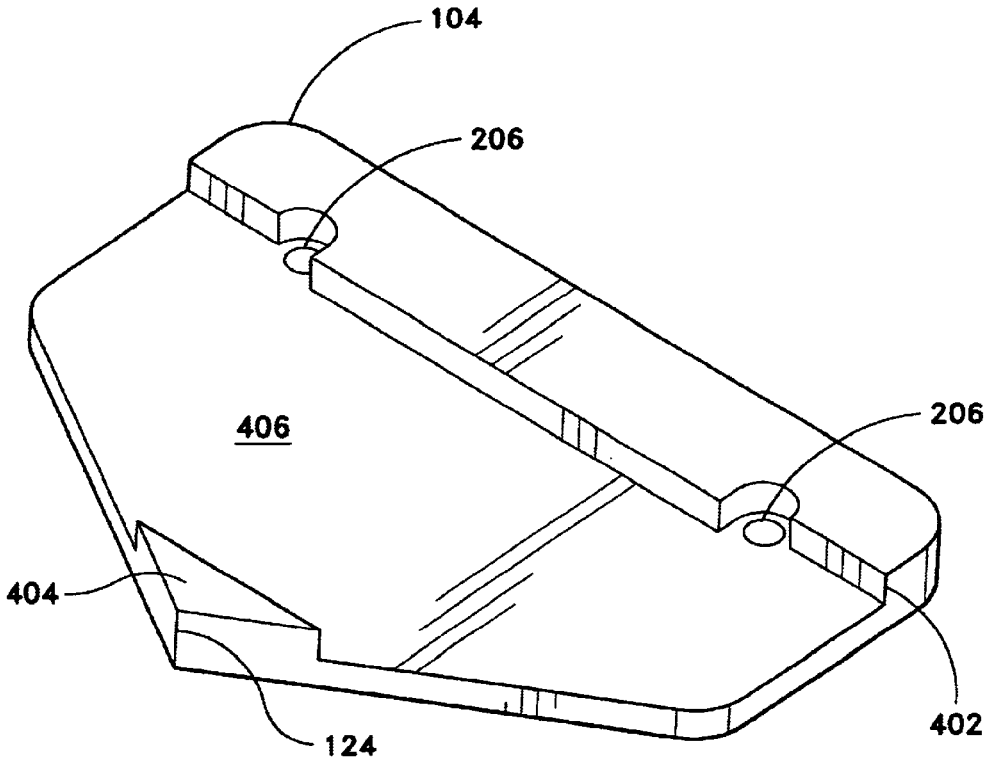
FIG. 4 is a bottom perspective view of the hat brim retaining plate of the head apparel embroidery hoop and alignment device according to the present invention.

The retaining plate 104 which secures the hat bill in an aligned position against the frame 102, has a left side, a right side, a proximate end and a distal end, the proximate end having two apertures 206 cut therein, the left and right sides converging in a point 124 extending generally to the inner perimeter 120 of the frame 102. As shown in FIG. 4, the bottom surface 406 of the retaining plate 104 is defined by first and second ledges 402, 404, wherein the ledges cooperatively engage the hat bill. The ledge 404, disposed at the point 124, biases the hat bill against the ribbed surface 112 of the frame 102 when the retaining plate 104 is clamped thereon.

The device has alignment marks 116 disposed on the outer perimeter 122 of the frame 102 to ensure correct alignment within the containment hoop 110 of the embroidery machine. Furthermore, alignment markings 118 disposed on the retaining plate 104 and a V-groove 114 disposed on the frame 102 on the opposite side from the retaining plate 104 enable proper alignment of the hat within the embroidery hoop 100.

The bottom of the frame 102 is smooth to ensure good adhesion with a sheet of adhesive stabilizing material 204, which advantageously secures the area to be embroidered in the desired position.

The embroidery hoop 100 is best utilized by securing the hoop 100 within an existing shaped containment hoop 110, the alignment of the inner hoop 100 with the outer containment hoop 110 being facilitated by alignment marks disposed on both devices. Once the front of the hat 108 is aligned and secured under the retaining plate 104, the user can have the rear seam stretched and centered immediately using the V-groove 114 disposed on the opposite side of the frame 102. Depressing the area to be embroidered into the adhesive stabilizer 204 while the seam is centered maintains the cap 108 in proper alignment during embroidery.

It is to be understood that the present invention is not limited to the embodiments described above, but encompasses any and all embodiments within the scope of the following claims.

We claim:

1. A head apparel embroidery hoop and alignment device for use in conjunction with an embroidery machine for embroidering and monogramming a cap, comprising:

a substantially flat, planar frame having an upper surface and a lower surface, a front and a rear, an inner perimeter defining an opening adapted for receiving a cap to be embroidered, an outer perimeter adapted for being secured to a containment hoop of the embroidery machine, and a centered rear alignment groove defined in the upper surface at the rear of the frame; and a retaining plate having an upper and lower surface, said retaining plate removably clamped to the frame;

whereby a cap secured within the frame by said retaining plate and maintained in proper alignment with the rear alignment groove is positioned within the containment hoop of an embroidery machine in order to present an area to be embroidered to an embroidery machine.

2. The head apparel embroidery hoop and alignment device according to claim 1, further comprising alignment indicia disposed on the upper surface of the frame at the front for indicating proper alignment of said frame with the containment hoop of the embroidery machine.

3. The head apparel embroidery hoop and alignment device according to claim 1, further comprising clamping means for releasably securing the cap between said retaining plate and said frame.

4. The head apparel embroidery hoop and alignment device according to claim 1, further comprising:

a pair of threaded posts extend from the upper surface of said frame; and a pair of threaded knobs engaging the threaded posts, said retaining plate having a pair of apertures defined therein, whereby said retainer plate is placed on the posts and clamped by the threaded knobs.

5. The head apparel embroidery hoop and alignment device according to claim 1, wherein said frame and said retaining plate are formed of molded plastic.

6. The head apparel embroidery hoop and alignment device according to claim 1, wherein said frame has a ribbed portion disposed on the upper surface, the ribbed portion sloping inward from the front towards said inner perimeter, the ribbed portion being adapted for frictionally engaging a bill of the cap when the cap is clamped between said retaining plate and said frame.

7. The head apparel embroidery hoop and alignment device according to claim 1, wherein said inner perimeter has an arcuate sloping contour extending downwards from the upper surface of said frame towards the opening for guiding errant movements of an embroidery needle away from the upper surface of said frame.

8. The head apparel embroidery hoop and alignment device according to claim 1, further comprising a stabilizer adapted for attachment to the lower surface of said frame, the stabilizer having an adhesive layer capable of removably securing the area to be embroidered within said opening.

9. The head apparel embroidery hoop and alignment device according to claim 8, wherein the lower surface of said frame is comprised of a smooth planar surface capable of adhesively receiving said adhesive stabilizer.

10. The head apparel embroidery hoop and alignment device according to claim 1, wherein said retaining plate has a proximate end having two apertures defined therein, a left side and a right side converging in a point at a distal end, said point extending towards the inner perimeter of said frame when said retaining plate is clamped to the frame.

11. The head apparel embroidery hoop and alignment device according to claim 10, wherein the lower surface of said retaining plate further comprises first and second ledges projecting from opposite ends of the lower surface, said ledges being adapted for cooperatively engaging a bill of the cap, said first ledge being disposed underneath said point and being adapted for biasing the bill against the upper surface of said frame when said retaining plate is clamped to said frame.

12. A head apparel embroidery hoop and alignment device for use in conjunction with an embroidery machine for embroidering and monogramming a cap, comprising:

a frame having an upper surface and a lower surface, a front and a rear, an inner perimeter defining an opening adapted for receiving the portion of a hat to be embroidered, an outer perimeter adapted to be secured within a containment hoop of the embroidery machine, and a centered rear groove defined in the upper surface at the rear for facilitating proper alignment of the hat within said frame; and a retaining plate having a upper and lower surface, the retaining plate removably clamped to the frame, the retaining plate further comprising a proximate end having two apertures defined therein, a left side and a right side converging in a point at a distal end, the point extending towards the opening of the frame;

wherein the lower surface of the retaining plate has first and second ledges, the ledges being adapted for cooperatively engaging a bill of the cap, the first ledge being disposed underneath the point for biasing the bill against the upper surface of the frame when the retaining plate is clamped thereon;

whereby a cap clamped between the retaining plate and the frame and maintained in proper alignment with the alignment groove defined in the upper surface of the frame is adapted for aligning within the containment hoop of the embroidery machine in order to present an area to be embroidered to the embroidery machine.

* * * * *